United States Patent [19]

Faix

[11] 4,185,660

[45] Jan. 29, 1980

[54] DIRECTIONAL CONTROL VALVE

[75] Inventor: James E. Faix, Pittsburgh, Pa.

[73] Assignee: Consolidation Coal Company, Pittsburgh, Pa.

[21] Appl. No.: 879,906

[22] Filed: Feb. 21, 1978

[51] Int. Cl.[2] ..... F15B 13/043

[52] U.S. Cl. ..... 137/625.64; 137/625.63; 137/625.66; 251/297

[58] Field of Search ..... 137/625.6, 625.63, 625.64, 137/625.66; 251/297

[56] References Cited

U.S. PATENT DOCUMENTS

| | | | |
|---|---|---|---|
| 2,725,077 | 11/1955 | Nicholl | 137/625.64 |
| 3,511,276 | 5/1970 | Jessen et al. | 137/624.27 |
| 3,640,146 | 2/1972 | Barnes | 137/624.27 X |
| 4,041,983 | 8/1977 | Bianchetta | 137/625.66 X |
| 4,046,165 | 9/1977 | Rose et al. | 137/625.66 X |

*Primary Examiner*—Gerald A. Michalsky
*Attorney, Agent, or Firm*—William A. Mikesell, Jr.; Stanley J. Price, Jr.; John M. Adams

[57] ABSTRACT

A cylindrical valve spool is slidably positioned in a chamber of a valve housing having a plurality of fluid inlet ports and a plurality of fluid outlet ports. The valve spool is movable to a selected one of a plurality of positions to interconnect a selected inlet port with a selected output port. A detent apparatus is associated with one end of the valve spool and is operable to lock the valve spool in one of three positions in the chamber. A remotely operated first pilot valve is operable to convey pressurized fluid to either end of the valve spool and thereby shift the valve spool to either a first or second end position for interconnecting selected inlet and outlet ports. A centering device is operable to shift the valve spool from either detented end position to a detented center or neutral position by deactivating the pilot valve and simultaneously conveying pressurized fluid from a second pilot valve to the centering apparatus. The centering apparatus includes a pair of pistons movably positioned in a fluid chamber arranged to receive pressurized fluid. The pistons have a limited stroke between a retracted position and an extended position. The fluid chambers are pressurized by activating the second pilot valve and deactivating the first pilot valve. This moves the pistons to the extended position and pivots a shifting lever connected to the valve spool to move the valve spool from either end position to the center position in the valve chamber. The detent apparatus locks the valve spool in the neutral position until the valve spool is shifted to another position by operation of the first pilot valve.

8 Claims, 6 Drawing Figures

DIRECTIONAL CONTROL VALVE

BACKGROUND OF THE INVENTION

1. Field of the Invention

This invention relates to a multi-position directional control valve, and more particularly to a spool-type valve that is operable by either a lever or a pilot valve to move a valve spool to a detented center position between two detented end positions.

2. Description of the Prior Art

Pilot operated directional control valves for directing fluid flow in a preselected direction from a valve chamber by slidable movement of a valve member, such as a spool-type valve member, in the valve chamber are known in the art. The known spool-type valve member is operable to place in a preselected configuration inlet, tank and outlet ports in fluid communication with respect to one another by sliding the valve spool to a preselected position in the valve chamber. A conventional pilot operated valve spool is shifted to either one of two extreme end positions by conducting pressurized fluid to one end of the valve spool and venting the opposite end of the valve spool. This shifts the valve spool to a first end position where selected inlets and outlets are interconnected in one configuration for selected directional flow through the valve chamber. To change the directional flow through the valve chamber a second configuration of inlets and outlets is arranged by shifting the valve spool to a second end position by reversing the flow of pressurized fluid to the ends of the valve spool.

The shifting movement of the valve spool, either left or right, is accomplished by operation of an electrohydraulic pilot valve as known in the art. The pilot valve is actuated to supply fluid under pressure to a selected end of the valve spool and to vent the opposite end to tank. In this manner the valve spool is shifted to either one of two extreme end positions.

With the above described pilot operated directional valve, the valve spool is shifted to a center position between the two extreme end positions by springs positioned between the ends of the valve spool and the end walls of the valve chamber. In the absence of fluid pressure at the ends of the valve spool, the centering springs bias the valve spool in a center position within the valve chamber. In this position the fluid is directed in a third pattern or configuration through the valve chamber where, for example, the inlet port is connected to a tank port and two outlet ports are blocked. Thus the valve spool is normally maintained in the center position by the centering forces exerted upon the valve spool by the end springs. Actuation of the pilot valve supplies fluid to a selected end of the valve spool to overcome the centering forces exerted upon the valve spool in order to move the valve spool from the center position to one of the extreme end positions. Constant pilot pressure must therefore be exerted upon the valve spool to maintain the end position. To return the valve spool to the center position the pilot valve is deactuated to remove the pilot pressure from either end of the valve spool. The centering springs are then free to act on the valve spool to return the spool to the center position.

It is also known with pilot operated valves to overcome the spring forces exerted upon the valve spool by displacing the valve spool through a manually operated lever. The lever is pivotally connected to the valve spool and by shifting the lever either left or right, the valve spool is shifted in a corresponding direction. However, with such an arrangement, the operator must maintain the lever in the shifted position to overcome the spring forces normally urging the valve spool to the center position. This has the disadvantage of leaving the operator with only one free hand to manipulate other devices, such as another control valve for example in the operation of a hydraulically controlled vehicle. For vehicles and other devices with more than two controls, such an arrangement provides for an inefficient operation.

Three-position, lever operated and detented directional control valves are known and are operable to shift a valve spool by operation of a lever to one of three positions, either of two end positions or a center position. The lever is connected to the valve spool in a manner to permit the operator to shift the valve spool to one of three positions. A detent mechanism within the valve housing maintains the valve spool in the selected position so that the operator may release his hand from the lever to operate other hand controlled devices.

Generally the detent mechanism includes a pair of ball bearings which are carried by the valve spool and are biased by a compression spring inserted between the ball bearings. The ball bearings are mounted transverse to the spool. The spring normally tends to urge the ball bearings into one of three annular detents or grooves formed in a sleeve surrounding the spool and fixed in the valve housing. Each detent corresponds to one of the three valve positions. When the ball bearings are positioned oppositely of a selected detent by movement of the valve spool, the spring moves the ball bearings into engagement with the detent to lock the valve spool in a preselected position. The valve spool is shifted to engage the ball bearings with a selected detent by operation of the lever. Movement of the lever overcomes the detent spring force and shifts the valve spool to another position.

In a directional control valve there is need for apparatus to combine the features of pilot-operated control valves and internally detented control valves. While it has been suggested by the prior art devices to pilot operate a directional control valve to move a valve spool between two end positions of travel, the prior art devices require a constant force, either hydraulic or manual, to be exerted upon the valve spool to hold the spool at either end position. Even though known internally detented control valves are operable to provide three positions for the spool without the need for a constant force to be exerted upon an end of the spool to hold it in position, this arrangement is not pilot operable in all three spool positions. Therefore, there is need for a three position, internally detented control valve that is pilot operated by a conventional electrohydraulic pilot valve. Such a device would provide hands off operation of the control valve and maintain the valve spool in either end position or the center position without requiring a preselected pressure differential acting on the valve spool or manually maintaining the spool in a preselected position.

SUMMARY OF THE INVENTION

In accordance with the present invention there is provided a directional control valve having a valve housing with a chamber in the housing. Inlet port means is provided in the housing and communicates with the chamber to supply fluid from the source to the chamber. A plurality of outlet ports are positioned in the housing and communicate with the chamber. A valve member is slidably positioned in the valve chamber. The valve member is operable to place the inlet port means and the outlet ports in fluid communication in a preselected arrangement with each other. A pilot valve control apparatus moves the valve member in the chamber in a first direction to a first end position to place in a first arrangement the inlet port means in fluid communication with the outlet ports. The pilot valve control apparatus is further operable to move the valve member in a second direction to a second end position and thereby place in a second arrangement the inlet port means in a fluid communication with the other outlet ports. A centering device having a predetermined length of travel between a first position and a second position is operable to move the valve member from either one of the first or second end positions in the chamber, a distance corresponding to the predetermined length of travel of the centering device to a center position between the first and second end positions. An actuator is provided for moving the centering device to the second position to position the valve member in the center position.

The valve member is preferably a spool-type valve member slidably positioned in the valve chamber to place the inlet port means and the outlet ports in fluid communication in a preselected arrangement where fluid from a pump source flows in one direction through the chamber and is redirected through the chamber in another direction to the tank. In one embodiment when the valve spool is moved to a first position upon actuation of the pilot valve control apparatus, fluid is directed through one inlet port to a first outlet port and returned through a second outlet port to a return port and a tank. In the first position the valve spool is moved to one extreme end of the valve chamber. A second position is provided when the pilot valve control apparatus is actuated to shift the valve spool laterally in the valve chamber to the opposite extreme end of the valve chamber. In this position the inlet port is placed in communication with the second outlet port and the first outlet port is placed in communication with the return port. In this manner a preselected flow pattern through the valve chamber is selected.

When the valve spool is moved in the valve chamber to a third position between the first and second positions, the inlet port means is placed in communication with a return outlet port communicating with a tank and the first and second outlet ports are blocked from communication with the valve chamber. The third position of the valve spool is preferably centered between the two end positions of the valve spool and is referred to as the neutral position of the valve spool.

When the valve spool is moved to a preselected position in the valve chamber for directing fluid in a preselected direction from the valve housing, the valve spool is maintained in that selected position by a spring biased detent arrangement. The detent arrangement locks the valve spool in a preselected position so that continuous control pressure to a selected end of the valve spool is not required to maintain a selected position of the valve spool. In this manner the valve spool is locked against movement in the valve chamber and is retained in one of the three valve positions corresponding to a preselected arrangement of communicating inlet and outlet ports.

For the directional valve of the present invention having two outlet port and one return port, fluid entering the inlet port is directed in any one of three directions from the valve chamber. The specific direction of flow is controlled by the pilot valve control apparatus which is preferably an electrically actuated pilot valve. The pilot valve conducts control pressure to a preselected end of the valve spool so that a pressure differential is exerted on the valve spool to shift it laterally to either the first or second end position. When the valve spool is moved to one of the end positions, the detent arrangement locks the valve spool in position so that it is not necessary to maintain constant control pressure on one end of the valve spool. By redirecting flow of pilot fluid to the opposite end of the valve spool, the valve spool is disengaged from its locked position and shifted laterally until locked in the opposite extreme end position by the detent arrangement.

The neutral position of the valve spool centered between the end positions in the valve chamber is provided by operation of the centering device. The centering device preferably includes in one embodiment a pair of piston-type devices that are slidably positioned adjacent to and oppositely of a lever that is pivotally connected to the valve spool. The lever is linked to a handle which is manually operated to shift the valve spool laterally to any one of the selected positions in the valve chamber.

Each piston is slidably retained in a chamber bore and includes one end portion exposed to a source of pressurized fluid which is operable to act on the end of the piston. The opposite end is movable into contact with the lever. Each piston has a limited length of travel or stroke in the chamber bore to move between a fully retracted position displaced from contact with the lever to a fully extended position abutting the lever. By conducting fluid to the one end of each piston, the piston is moved to its extended position. Depending on the position of the valve spool, one of the pistons contacts the lever to shift it to a vertical position. Moving the lever to a vertical position moves the valve spool to the neutral position in the valve chamber. In this manner the valve spool is moved from either one of the extreme end positions in the valve chamber to the neutral position.

In the neutral position both pistons are fully extended in their chamber bores and positioned in abutting relation with the lever to maintain the lever in a vertical position. As long as the lever remains in a vertical position, the valve spool remains in a neutral position. Further, as long as the pistons remain fully extended in their respective chamber bores, the neutral position of the valve spool is maintained.

The actuating means for moving the pistons to their fully extended positions is in one embodiment of the present invention a separate pilot control valve which is actuated when the pilot control valve for shifting the valve spool is deactuated. Thus, when operated the separate pilot control valve simultaneously conducts fluid to the ends of the pistons in their respective chambers to move the pistons from a fully retracted position to a fully extended position in their respective chamber bores.

Accordingly, the principal object of the present invention is to provide a pilot and lever operated three position, directional control valve having a valve member that is slidably movable in a valve chamber to direct fluid flow in a preselected direction from the valve chamber and is operable to be maintained in a neutral position within the valve chamber without requiring conventional centering means to exert forces upon the ends of the valve member.

Another object of the present invention, is to provide a remotely controllable, pilot operated directional control valve having a valve spool that is movable into one of three positions in a valve chamber corresponding to two end positions and a center position with the valve spool being locked in a selected position by a detent mechanism and movable to one of the positions by operation of pilot valve means or by a manually operable lever.

A further object of the present invention, is to provide a directional control valve that is both pilot and lever operated to move to one of three positions and is maintained in a selected position by a detent mechanism.

These and other objects of the present invention will be more completely disclosed and described in the following specification, the accompanying drawings and the appended claims.

DESCRIPTION OF THE PREFERRED EMBODIMENTS

Figures 1, 1A:
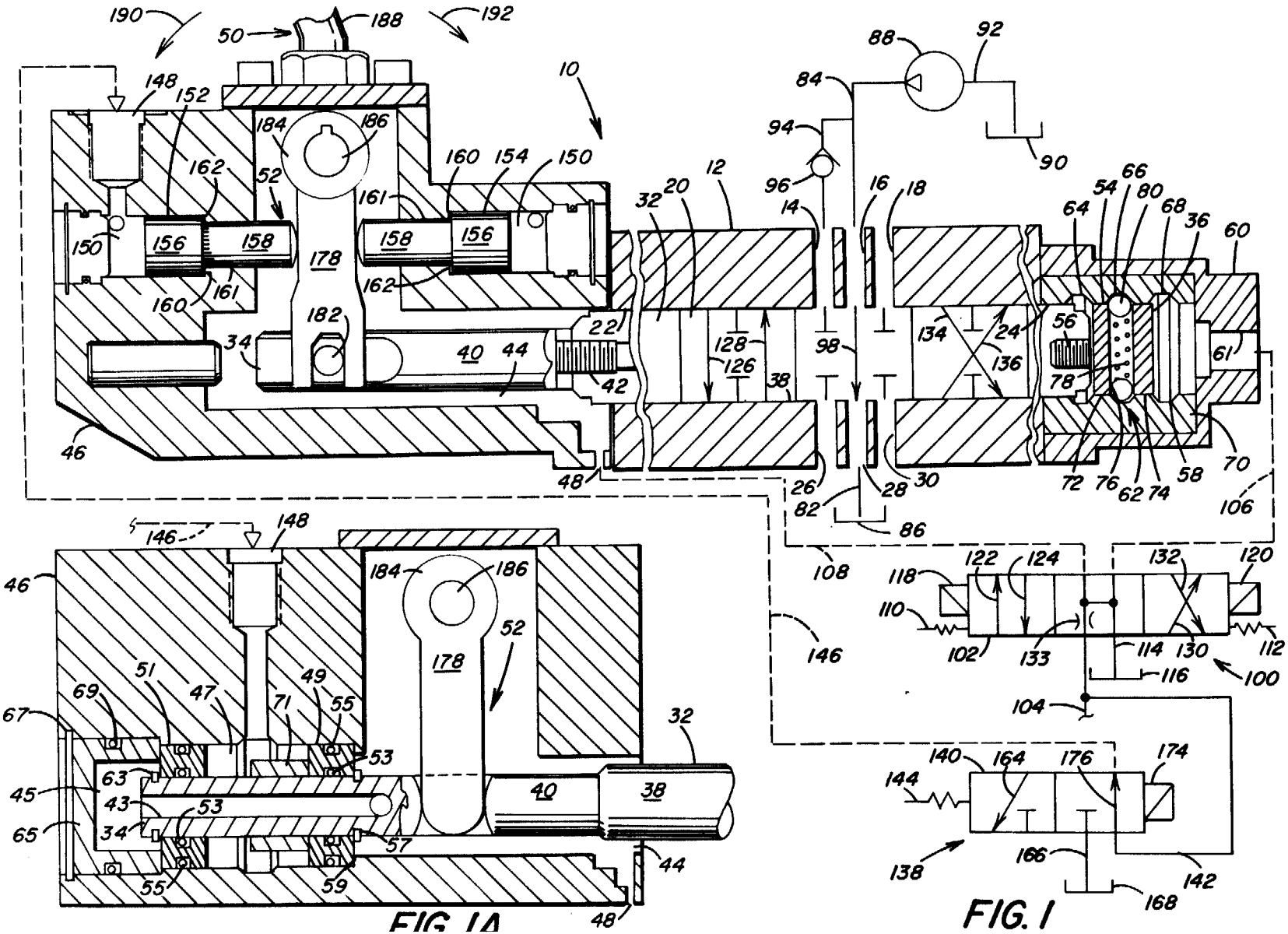
FIG. 1 is a schematic view in side elevation, and partially in section, of a directional control valve having a valve member movable to one of three positions in a valve chamber for conveying fluid in a preselected direction from the valve chamber, illustrating schematically the valve member centered in a neutral position in the valve chamber between two end positions.
FIG. 1A is a fragmentary, sectional view in side elevation of an alternate embodiment of the centering apparatus for the control valve.
Figure 2:
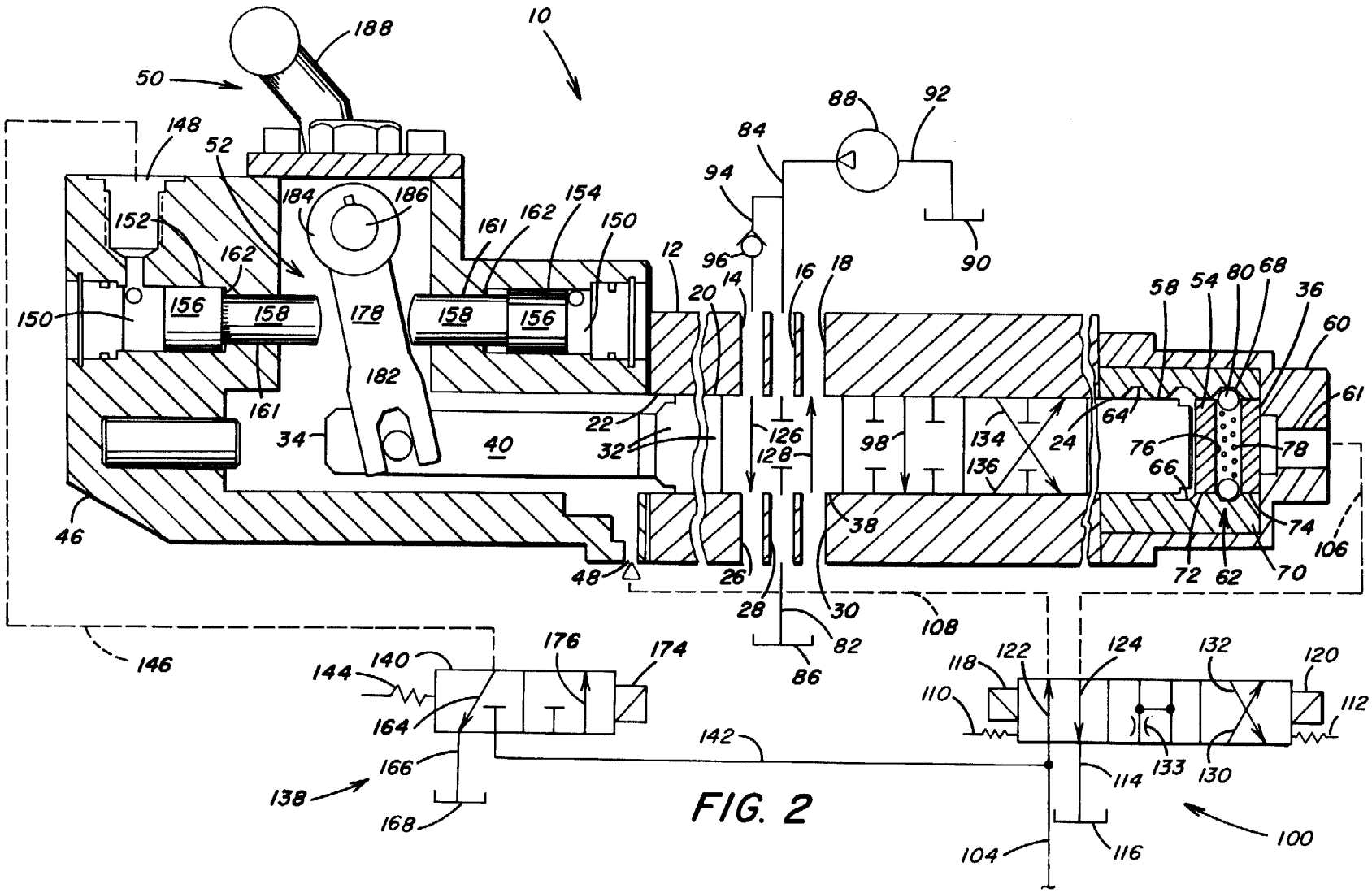
FIG. 2 is a schematic view of the directional control valve shown in FIG. 1, illustrating the valve member moved to a first end position in the valve chamber.
Figure 3:
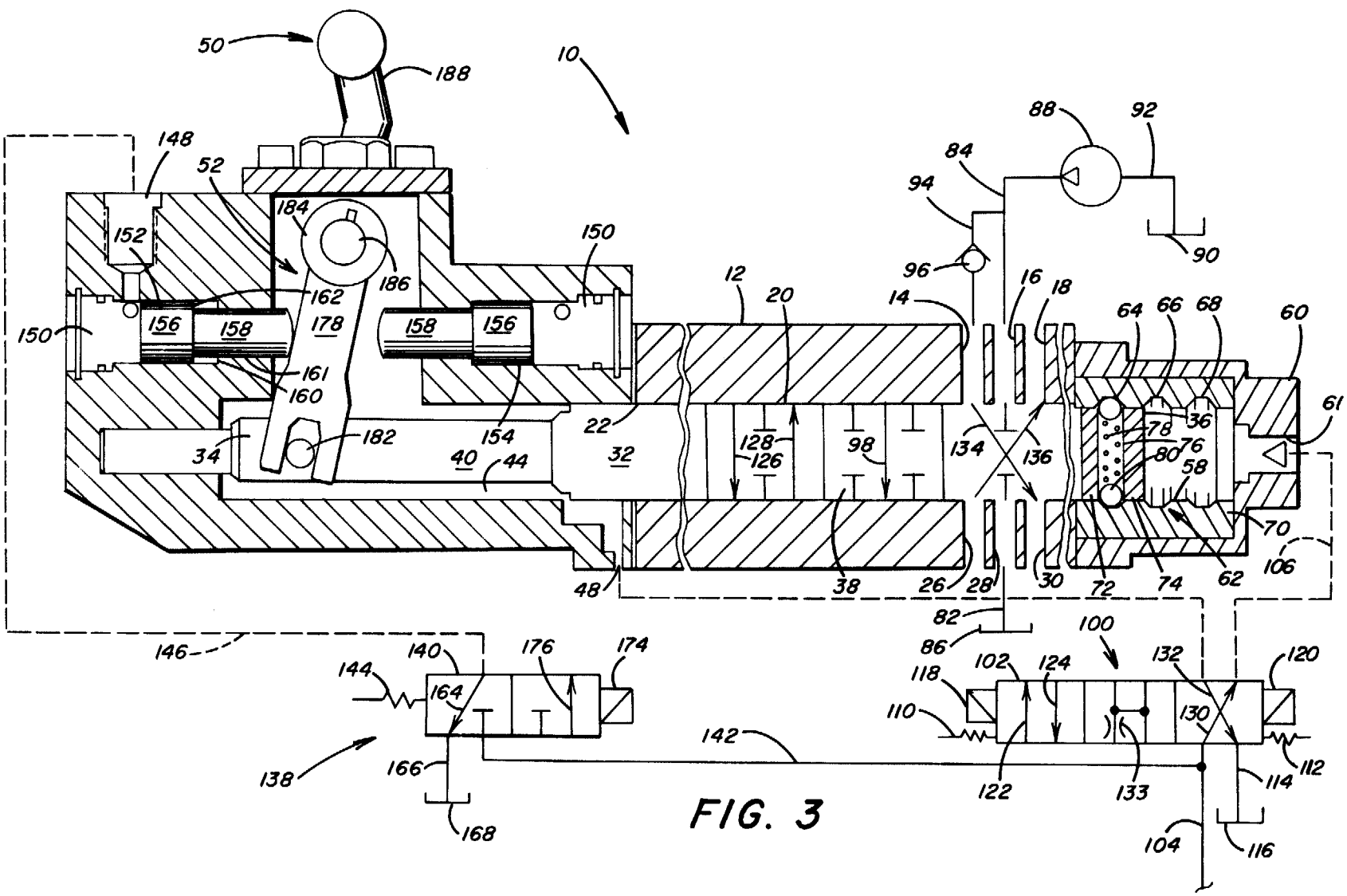
FIG. 3 is a schematic view of the directional control valve shown in FIG. 1, illustrating the valve member moved to a second end position in the valve chamber.

Referring to the drawings and particularly to FIGS. 1-3, there is illustrated a directional control valve generally designated by the numeral 10 for conveying pressurized fluid from a source in a preselected direction. The directional control valve 10, as illustrated in FIG. 1, includes a valve housing 12 having a pair of inlet ports 14 and 16 and a return port 18. The inlet ports and the tank port communicate with a valve chamber 20 which may have the configuration of a cylindrical bore extending through the valve housing. The valve chamber 20 forms aligned open end portions 22 and 24 in the valve housing 12. A pair of ports 26 and 30 and a return port 28 extend through the valve housing 12 and communicate with the valve chamber 20. A valve member 32 is slidably positioned in the valve chamber 20. The valve member 32 is operable to place either inlet ports 4 or 16 in fluid communication with a selected one of ports 26–30 in a manner to direct inlet fluid through a selected one of the ports 26–30. The valve member 32 may have a selected configuration that places the inlet ports in fluid communication with selected outlet ports as for example a spool-type valve member having a series of undercuts and lands arranged to place the inlet ports in fluid communication with selected outlet ports.

As illustrated in FIG. 1, the valve member has a first end 34 that extends through the open end portion 22 of the valve chamber and a second end 36 that extends through the open end portion 24 of the valve chamber. In the specific arrangement illustrated in FIG. 1, the valve member 32 includes an intermediate portion 38 that is positioned within the valve chamber 20. Though not illustrated in FIG. 1, it should be understood that it is the center portion 38 of the valve member 32 that includes the series of undercuts and lands. However, this configuration is well known in the art and has been omitted for purposes of illustration.

The valve member 32 includes at the first end 34 an end portion 40 that is axially aligned with the center portion 38 and is connected thereto by a threaded member 42. The end portion 40 is positioned within a fluid chamber 44 of an end housing 46 that is suitably connected to the valve housing 12 to form a fluid tight connection between the housings 12 and 46. The valve member center portion 38 and end portion 40 are operable to shift laterally in the communicating chambers 20 and 44.

The end housing 46 has a pilot port 48, and pressurized fluid is conveyed through the pilot port 48 into the fluid chamber 44 to exert pressure upon the first end 34 of valve member 32. In this manner the valve member 32 is shifted laterally in a first direction to a first end position, as illustrated in FIG. 2, for directing inlet fluid from inlet 14 through the valve chamber 20 to the outlet port 26 and for directing return fluid from outlet port 30 through the valve chamber 20 to return port 18, which preferably communicates with a tank (not shown). The end housing 46 also contains a manual override control generally designated by the numeral 50 and valve member centering apparatus generally designated by the numeral 52 which will be explained later in greater detail.

The valve member 32 also includes an end portion 54 at the second end 36 of valve member 32. The end portion 54 is connected to the valve member center portion 38 by a threaded member 56. The end portion 54 is slidably disposed in a fluid chamber 58 of an end housing 60 that is secured in a conventional manner to the valve housing 12 so as to provide a fluid tight seal between the valve housing 12 and the end housing 60 around the chambers 20 and 58. The end housing 60 includes a pilot port 61 through which pressurized fluid is conveyed and directed into the chamber 58 to exert pressure upon the valve member end portion 54. In this manner the valve member 32 is shifted laterally in a second direction opposite to the first direction of movement to a second position as illustrated in FIG. 3. The valve member 32 in the second position conveys inlet fluid from the inlet port 14 through the valve chamber 20 to the outlet port 30 and conveys return fluid from outlet port 26 through the valve chamber 20 to the return port 18.

The valve member 32 is maintained in one of the three positions illustrated in FIGS. 1-3, i.e. one of the two end positions as illustrated in FIGS. 2 and 3 or the neutral position as illustrated in FIG. 1, by a detent apparatus generally designated by the numeral 62 located at the second end 36 of valve member 32. The detent apparatus 62 includes a plurality of grooves or annular recesses 64, 66 and 68 formed in a sleeve 70 that is retained within the end housing 60. The axial bore of sleeve 70 forms the chamber 58 and the recesses 64–68 are cut in an annular arrangement into the body of the sleeve 70. The recesses are longitudinally spaced from one another along the longitudinal axis of the sleeve 70.

The cylindrical valve member end portion 54 includes a hole 76 drilled transverse to the longitudinal axis of the valve member 32 forming spaced body portions 72 and 74 on end portion 54. A resilient device, such as a compression spring 78, is retained within the transverse hole 76 and a pair of ball bearings 80 are positioned within the transverse hole 76 in overlying relation with the spring 78. With this arrangement the ball bearings 80 are normally biased by the spring 78 into one of the recesses 64–68. When the valve member 32 is positioned, as illustrated in FIG. 1, the ball bearings 80 engage recess 66 to lock the valve member 32 in the neutral position for directing fluid flow from inlet port 16 to tank port 28.

As illustrated in FIG. 2, the outlet 28 is aligned with a conduit 82 for conveying fluid from a conduit 84 to a fluid reservoir or tank 86. The conduit 84 is connected to an outlet of a hydraulic pump 88 that is operable in a well-known manner to conduit fluid from a source such as reservoir 90 through a conduit 92 to conduit 84 at a preselected flow rate. A by-pass conduit or passage 94 is shown connected at one end to the conduit 84 and at the opposite end by a conventional check valve 96 to the inlet port 14. Frequently the by-pass passage 94 and check valve 96 are built into the valve housing 12. With this arrangement, as illustrated in FIG. 1, when the valve member 32 is centered in the neutral position the valve member 32 closes the inlet port 14 and the return port 18, as well as the outlet ports 26 and 30, but connects the inlet port 16 as indicated by the arrow 98 with the outlet port 28. This directs fluid flow from conduit 84 to conduit 82 and the tank 86.

Movement of the valve member 32 to any one of the three positions is accomplished remotely of the valve housing 12 by operation of a pilot valve generally designated by the numeral 100. The pilot valve 100 can be a conventional solenoid operated valve that includes a valve member 102, as schematically illustrated in FIGS. 1–3. Valve member 102 is operable to control the flow of pressurized fluid from a control conduit 104 connected to a fluid pressure source (not shown) to a respective one of the pilot conduits 108 and 106. The pilot conduits 108 and 106 are connected to the pilot ports 48 and 61 respectively of the valve housing 12. In this manner fluid is conveyed to a selected end of the valve member 32 for shifting the valve member to a selected one of the end portions.

As illustrated in FIG. 1, valve member 102 of pilot valve 100 is normally centered by resilient devices 110 and 112 acting on the ends of the valve member 102 in a neutral position. In a neutral position the control pressure from control conduit 104 drops to tank pressure after fluid flows through internal orifice or restriction 133 and has no impetus to enter either one of the pilot conduits 106 or 108 and is directed by the valve to a conduit 114 which extends to a tank 116. Thus with this arrangement the pilot ports 48 and 61 of the valve housing 12 are vented when the pilot valve 110 is denergized.

The pilot valve 100 is energized by actuating either one of solenoids 118 or 120 associated therewith to move the valve member 102 in a preselected direction from its neutral position. As illustrated in FIG. 2, by energizing solenoid 118 the valve member 102 is shifted laterally from the neutral position to transmit fluid from control conduit 104 through the valve in the direction indicated by arrow 122 to the pilot conduit 108 and from pilot circuit 106 through the valve as indicated by the arrow 124 to conduit 114 and tank 116. In this manner pressurized fluid is supplied to the pilot port 48; while pilot port 61 is vented to tank 116. An unequal pressure distribution is exerted upon the valve member 32 sufficient to move the ball bearings 80 out of the recess 66 to permit the valve member 32 to move laterally toward the end housing 60 until the ball bearings 80 engage the recess 68. Thus the valve member 32 is locked in the end position, illustrated in FIG. 2. Once the valve member 32 is shifted to this end position the pilot valve 100 can be deenergized, and the valve member 32 remains locked in place.

When the valve member 32 is shifted to the end position illustrated in FIG. 2, fluid flow is transmitted from conduit 84 through conduit 94 and the check valve 96 into the inlet port 14. From the inlet port 14 the valve member 32 directs flow through the valve chamber 20 in the direction of arrow 126 to the outlet port 26 and directs return flow from outlet port 30 through chamber 20 in the direction of arrow 128 to tank port 18. In a specific application of the directional control valve 10, fluid flowing from the outlet 26 may be directed to a hydraulically operated motor in a first direction to rotate the output shaft of the motor in a first direction. Accordingly, fluid would be directed from the motor to outlet port 30 through the valve chamber in the direction indicated by the arrow 128 to the tank port 18 and therefrom to a fluid reservoir (not shown).

To shift the valve member to the opposite end position, illustrated in FIG. 3, the solenoid 120 of pilot valve 100 is energized to thereby move the valve member 102 to the position where fluid is directed from control conduit 104 through the valve in the direction of arrow 130 to the pilot conduit 106. This transmits pilot fluid to the pilot port 61 at the second end 36 of valve member 32. While the pilot port 61 is pressurized, the pilot port 48 is vented to the tank 116 by placing the pilot conduit 108 in fluid communication with the conduit 114. Fluid from the pilot port 48 is thus conveyed through pilot valve 110 in the direction of arrow 132 to tank 116.

The pilot pressure exerted upon the valve end portion 54 is sufficient to move the ball bearings 80 out of engagement with recess 66 or 68 and permit the valve member 32 to shift laterally unit the ball bearings 80 are positioned oppositely of recess 64. In this position the spring 78 urges the ball bearings 80 into engagement with the recess 64. Once shifted to the position illustrated in FIG. 3, the valve member 32 remains in this position by the locking action of the detent apparatus 62 until the valve member 32 is shifted by operation of either the pilot valve 100 or the pilot valve 138 or the manual override control 50.

Shifting of the valve member in the valve chamber 20 to the position illustrated in FIG. 3 places the inlet port 14 in fluid communication with the outlet port 30 so that fluid from conduits 84 and 94 is directed from the inlet port 14 in the direction of arrow 134 to outlet port 30. In addition, the outlet port 26 is placed in fluid communication with the tank port 18 for flow of fluid from outlet port 26 in the direction of arrow 136 to the tank port 18. In this manner as applied to the above example, the directional control valve 10 is operable to convey pressurized fluid in an opposite direction through a hydraulically operated motor to rotate the output shaft of the motor in a reverse direction. Thus, the fluid circulating through the motor is returned to the control valve 10 and conveyed from outlet port 26 by the valve member 32 in the direction of arrow 136 to the tank port 18.

The valve member 32 is retained in its second end position as illustrated in FIG. 3 by the locking engagement of the ball bearings 80 in the annular recess 64. This permits the pilot valve 100 to be deenergized. It is therefore not necessary to maintain constant fluid pressure upon the valve member second end 36 to retain the valve member 32 in the second end position. The valve member 32 will remain in the second end position by detent apparatus 62 until the valve member 32 is shifted by energizing either the pilot valve 100 or the pilot valve 138 or the manual override control 50.

In accordance with the present invention the valve member 32 is operable to move from either the first or second end position to a third or neutral position where the valve member 32 is centered in the valve member 20. In the neutral position, as illustrated in FIG. 1, the inlet port 14 and tank port 18 are blocked as are the outlet ports 26 and 30. However, the inlet port 16 is connected by the valve member 32 to the tank port 28 for flow of fluid from conduit 84 through the valve member in the direction of arrow 98 to the tank port 28 and the conduit 82 which conveys fluid to tank 86. As illustrated by the embodiments shown in FIGS. 1-3, the neutral or center position of the valve member 32 is accomplished by operation of a separate pilot operated valve generally designated by the numeral 138.

The pilot valve 138 includes a slidable valve member 140, as well known in the art, and is connected to the control conduit 104 that supplies pressurized fluid to the pilot valve 100 by conduit 142. The pilot valve 138 is a two position valve which is illustrated in its energized position in FIG. 1 and in its deenergized position in FIGS. 2 and 3. When the valve member 32 is in either end position, the pilot valve 100 is energized and the pilot valve 138 is deenergized. When the pilot valve 138 is deenergized, a spring 144 biases the valve member 140 in a position where the inlet port connected to conduit 142 is closed so that fluid from control conduit 104 is prevented from entering and passing through the pilot valve 138.

The pilot valve 138 operates the centering apparatus 52. A pilot conduit 146 connects the pilot valve 138 with a neutral port 148 in the end housing 46. The neutral port 148 communicates with a chamber 150 which, in turn, communicates with the fluid chamber 44 where the valve member end portion 40 is positioned. A pair of pistons 152 and 154 each has a cylindrical or enlarged base portion 156 and a rod portion 158 having a preselected length and a diameter less than the diameter of the cylindrical portion 156.

As illustrated in greater detail in FIG. 1, each chamber 150 has an enlarged portion arranged to slidably and sealingly receive the cylindrical portion 156 of pistons 152 and 154. The end housing 46 that contains the centering apparatus 52 forms a shoulder portion 160 that separates the enlarged portion of chamber 150 from a reduced portion of chamber 150 having a cylindrical passageway 161 of a diameter corresponding to the diameter of the rod portion 158 of each piston to permit slidable movement of the rod portion 158 in passageway 161. The cylindrical portion 156 and the rod portion 158 of each piston forms a shoulder 162. The piston rod portions 158 move from a fully retracted position in the fluid passageway 161 where shoulders 162 are spaced from the housing shoulders 160 to a fully extended position where the shoulder 160 and 162 are positioned in abutting relation. With this arrangement the pistons 152 and 154 seal fluid chamber 150 from fluid chamber 44.

When the pilot valve 138 is deenergized either one or both of the pistons 152 and 154 are retracted in the chamber 150. The spring 144 of valve 138 maintains the valve member 140 in a position for return flow of fluid from chamber 150 through pilot conduit 146 and the valve chamber 140 in the direction indicated by arrow 164 to a conduit 166 that is connected to a tank 168. The pilot port 148 communicates with the fluid chamber 150. With this arrangement by conducting fluid to pilot port 148 the chamber 150 is pressurized at the end portion 156 of each piston 152 and 154. The pilot valve 138 is electrically energized by a solenoid 174, schematically illustrated in FIGS. 1-3. The valve member 140 is shown in the deenergized position in FIGS. 2 and 3 and in the energized position in FIG. 1. By energizing the valve 138, conduit 142 is connected by the valve member 140 to the pilot conduit 146 for flow of fluid through the valve in the direction indicated by arrow 176.

In accordance with the practice of the present invention, when pilot valve 138 is energized pilot valve 100 is deenergized and the valve member 102 of valve 100 is positioned so that pressurized fluid is directed from control conduit 104 and drops to tank pressure after flowing through internal orifice 133 and then flows to conduit 114 leading to tank 116. This prevents either one of the pilot ports 48 and 61 of valve 10 from receiving pressurized fluid and vents the pilot ports for the flow of fluid from the fluid chambers 44 and 58 to tank 116. However, prior to energizing the pilot valve 138, the valve member 32 is either in the first or second extreme end position of either FIGS. 2 or 3, and the ball bearings 80 are engaged in either recess 64 or recess 68.

Energizing pilot valve 138 by actuating solenoid 174 shifts the valve member 140 against the force of spring 144 to position the valve member for conducting fluid through the valve in the direction of arrow 176 from conduit 142 to conduit 146 and from there to the pilot port 148 of the centering apparatus 52. Fluid thus enters chamber 150 and exerts pressure upon the pistons 152 and 154 to move the pistons from a fully retracted position until the pistons bottom out in the chamber 150 where the shoulders 160 abut shoulders 162.

A shifting lever 178 is pivotally connected by a forked end portion engaging a pin 182 that extends outwardly from valve member end portion 40 adjacent the first end 34. An opposite end portion 184 of the shifting lever 178 has a bore extending therethrough for receiving a shaft 186 that is keyed to the end portion 184. The shaft 186 extends through bushings (not shown) in the end housing 46 and the opposite end of the shaft 186 is connected to the end of a manually operated control handle 188. With this arrangement by manually rotating the control handle 188 in either one of the directions indicated by the arrows 190 or 192, the shifting lever 178 rotates in a corresponding direction about the axis of shaft 186 to shift the valve member 32 into one of the three positions as above described.

When the valve member 32 is in the end position illustrated in FIG. 2, the control handle 188 moves the lever 178 to retract the piston 154 in the chamber 150. The shoulder 162 of piston 154 is moved out of abutting relation with the housing shoulder 160. To center the valve member 32 in the chamber 20, pilot valve 100 is deenergized and the valve member 102 is moved to a center position for venting the pilot ports 48 and 61. The pilot valve 138 is then actuated to convey fluid to the pilot port 148 and chamber 150. In this manner piston 154 is moved to a fully extended position where shoulders 160 and 162 abut. If prior to centering the valve 32 in chamber 20 the valve member 32 was in the position of FIG. 3, the piston 154 would be fully extended and the piston 152 would be fully retracted in the chamber 150. Therefore, by pressurizing the chamber 150 the piston 152 is extended until it bottoms out in the chamber 150.

When the rod portions of each piston 152 and 154 are fully extended and bottomed out in the chamber 150, the shifting lever 178 is moved to a vertical position. Thus the pistons 152 and 154 have a limited stroke so that when both are fully extended and the ends of the rod portions abut the shifting lever 178, the shifting lever is vertically positioned. Movement of the shifting lever 178 to a vertical position moves the valve member 32 from either one of its extreme end positions to the neutral or center position. The ball bearings 80 are moved out of either recess 64 or 68 into recess 66 by the force of the spring 78 when the shifting movement of the lever 178 is completed.

Once the valve member 32 is shifted to the neutral or central position, as illustrated in FIG. 1, the valve member 32 remains in the center position by engagement of the ball bearings 80 with the recess 66. As long as the pistons 152 and 154 remain in a fully extended position in the chamber 150, the neutral position of valve member 32 is maintained. This permits a pressure to be exerted upon the cylindrical portions 156 of each piston, or no pressure to be exerted at all as long as the piston shoulders 162 remain in abutting relation with the housing shoulder 160.

Once the pistons 152 and 154 are bottomed in the chamber 150, the pressure exerted upon the pistons 152 and 154 may vary and as long as the rod portions are fully extended the shifting lever 178 remains vertical and the valve member 32 remains centered. Furthermore, the pilot valve 138 may be deenergized once the valve member 32 is centered because the compression spring 78 is operable to maintain the ball bearings 80 engaged within the recess 66 until the position of the valve is changed by energizing the pilot valve 100. Thus with the present invention a three position detented pilot and lever operated control valve is provided where the valve member may be maintained in a center position without the need for equal centering forces to be applied to the ends of the valve member to either move it to a center position or to maintain it in a center position.

Referring to FIG. 1A, there is illustrated another embodiment of the centering apparatus 52 for the control valve 10 illustrated in FIGS. 1–3. For purposes of simplicity of illustration, only the end housing 46 containing the second embodiment of centering apparatus 52 is illustrated in FIG. 1A. Therefore, it should be understood that the remaining components of the control valve 10 remain the same as illustrated in FIG. 1, such as the valve housing 12, the detent apparatus 62, and the pilot valves 100 and 138. Thus, like numerals of FIG. 1 refer to like parts in FIG. 1A.

The end housing 46 illustrated in FIG. 1A includes the fluid chamber 44 in which the central portion 38 and the end portion 40 of the valve member 32 are slidably positioned. The centering apparatus 52 is positioned in the chamber 44 and includes the shifting lever 178 that is pivotally connected in a conventional manner to the valve member end portion 40. The opposite end is connected by shaft 186 positioned in a bore of the lever 178 to the manually operated control handle 188. The chamber 44 communicates with a chamber 45 by a passageway 43 in the end portion 40 of valve member 32.

The chambers 44 and 45 receive pressurized fluid through the pilot port 48 from the conduit 108 connected to the pilot valve 100. The pilot port 148 communicates with a chamber 47 that is separated from fluid chambers 44 and 45 by pistons 49 and 51 that are slidably and sealingly positioned on both the valve member end portion 40 and chamber 47. With this arrangement the chamber 47 is sealed from the chambers 44 and 45. When the solenoid 174 of pilot valve 138 is energized fluid is conveyed from conduit 142 through the valve 138 to the conduit 146 and into the pilot port 148 and fluid chamber 47.

As described above, the fluid chamber 47 is sealed from the fluid chambers 44 and 45 by the pistons 49 and 51, which are concentrically mounted for longitudinal movement on the valve member end portion 40. Each piston 49 and 51 includes a pair of O-rings 53 and 55. O-ring 53 is positioned in a recess that extends radially from the bore of each piston and sealingly engages the outside diameter of the valve member end portion 40 to provide a seal around the valve member end portion. O-ring 55, with a similar construction, is retained in a recess on the outer cylindrical surface of each piston and is operable to engage the end housing 46 surrounding the fluid chamber 47 to thereby provide a seal between the outer diameter of each piston and the fluid chamber 47.

The piston 49, as illustrated in FIG. 1A, is longitudinally movable on the valve member end portion 40 to a position abutting both a snap ring 57, that is securely positioned on the valve member end portion 40, and an in-turned shoulder 59 of end housing 46. In a similar arrangement the piston 51 is slidably movable on the valve member end portion 40 to an extreme end position as illustrated in FIG. 1A into abutting relation with a snap ring 63 adjacent the end 34 of the valve member 32. The fluid chamber 45 is sealed by a cup-shaped end cap 65 that is immovably retained within chamber 45 by a snap ring 67. An O-ring 69 provides a fluid tight seal around the end cap 65 within the fluid chamber 45. A spacer 71 is slidably positioned on the valve member end portion 40 between the pistons 49 and 51 within the fluid chamber 47. The spacer 71 is operable to prevent the O-rings 55 of each piston from moving out of engagement with the end housing 46 and coming into communication with the undercut area beneath neutral port 148.

The directional control valve 10 having the end housing illustrated in FIG. 1A is movable into and out of the positions illustrated in FIGS. 1–3 in the manner above described for the embodiment illustrated in FIGS. 1–3. Conducting pressurized fluid to the pilot port 61 from the control valve 100 and venting the pilot port 48 to tank 116 places a pressure imbalance upon valve member 32 sufficient to move the ball bearings 80 from either recess 68 or 66 to recess 64. This shifting of the valve member 32 places the valve member in the position illustrated in FIG. 3. The shifting of the valve member 32 to this position is accomplished by venting fluid from the chambers 44, 45 and 47 and introducing fluid into chamber 58 of the opposite end of the valve member 32. As the valve member 32 shifts laterally, the snap ring 57 urges the piston 49 to move longitudinally toward the piston 51. Piston 49 continues to move longitudinally until the spacer 71 moving with piston 49 on end portion 40 abuts the end portion of piston 51 having its opposite end portion abutting the end cap 65.

Shifting the valve member 32 to the position illustrated in FIG. 2 is accomplished by energizing the pilot valve 100 to vent the pilot port 61 to tank 116 and conduct pressurized fluid to pilot port 48. In this manner, fluid is conveyed into the fluid chambers 44 and 45 from the pilot port 48. Chamber 45 communicates with chamber 44 though the passageway 43 extending from valve end 34 to adjacent the connection of lever 178 to valve end portion 40. Simultaneously with pressuring chambers 44 and 45, the chamber 47 is vented by deenergizing the pilot valve 138 to permit fluid to be exhausted from chamber 47 and conveyed from pilot conduit 146 through the pilot valve 138 to conduit 166 and tank 168. By pressuring fluid chambers 44 and 45 and venting the fluid chamber 58 at the opposite end of valve member 32, a pressure imbalance is exerted upon the valve member 32 to shift the valve member laterally and move the ball bearings out of the recess 64.

The valve member 32 continues to move laterally due to the pressure imbalance until the ball bearings engage the extreme end recess 68 where the valve member 32 is locked and positioned as illustrated in FIG. 2. As the valve member 32 moves from the position of FIG. 3 to the position of FIG. 2 the piston 51 is advanced longitudinally in the chamber 47 by the snap ring 63 on the end portion 40. The piston 51 continues to move laterally until it has moved the spacer 71 into abutting relation with the piston 49 which is, in turn, abutting the inturned shoulder 59 of the end housing 46. The valve member is retained in this position as long as the ball bearings engage the recess 68.

In accordance with the present invention the valve member 32 will remain in either extreme end position without the requirement for a continuous pressure imbalance on the valve member because the valve member is retained in its selected position by engagement of the ball bearings in either recess 64 or recess 68. Thus, once the valve member 32 has been moved to its selected end position, the pilot valve 100 may be deenergized to remove pilot pressure from the respective ends of the valve member 32.

Movement of the valve member 32 to a neutral or centered position as illustrated in FIG. 1A is accomplished by venting the pilot ports 48 and 61 to tank 116. This condition is obtained by deenergizing the pilot valve 100 to exhaust fluid from the chambers 44 and 45 at the end 34 of valve member 32 and from chamber 58 at the end 36 of valve member 32. Simultaneously with venting the pilot ports 48 and 61, the neutral port 148, as illustrated in FIG. 1A, is pressurized by energizing the pilot valve 138. Fluid is conveyed through the pilot port 148 into the fluid chamber 47; and fluid from fluid chambers 44 and 45 is conveyed to the tank 116. A pressure imbalance is exerted upon the pistons 49 and 51, moving the pistons in opposite directions longitudinally on the valve member end portion 40 into abutting relation with the snap rings 57 and 63.

Depending upon the initial position of the pistons 49 and 51 prior to centering the valve member 32, either piston 49 abutting snap ring 57 moves the end portion 40 and the valve member 32 laterally until the piston 49 abuts the housing shoulder 59 or piston 51 abutting snap ring 63 moves end portion 40 and valve member 32 laterally until piston 51 abuts end cap 65. When the valve member 32 has reached the neutral position as illustrated in FIG. 1A the pistons are positioned in their extreme end positions on the end portion 40, and accordingly the ball bearings have moved from either recess 64 or recess 68 into the center recess 66. The center position of the valve member 32 is maintained by engagement of the ball bearings 80 with the recess 66, and the pilot pressure may be removed from the neutral port 148.

Figure 4:
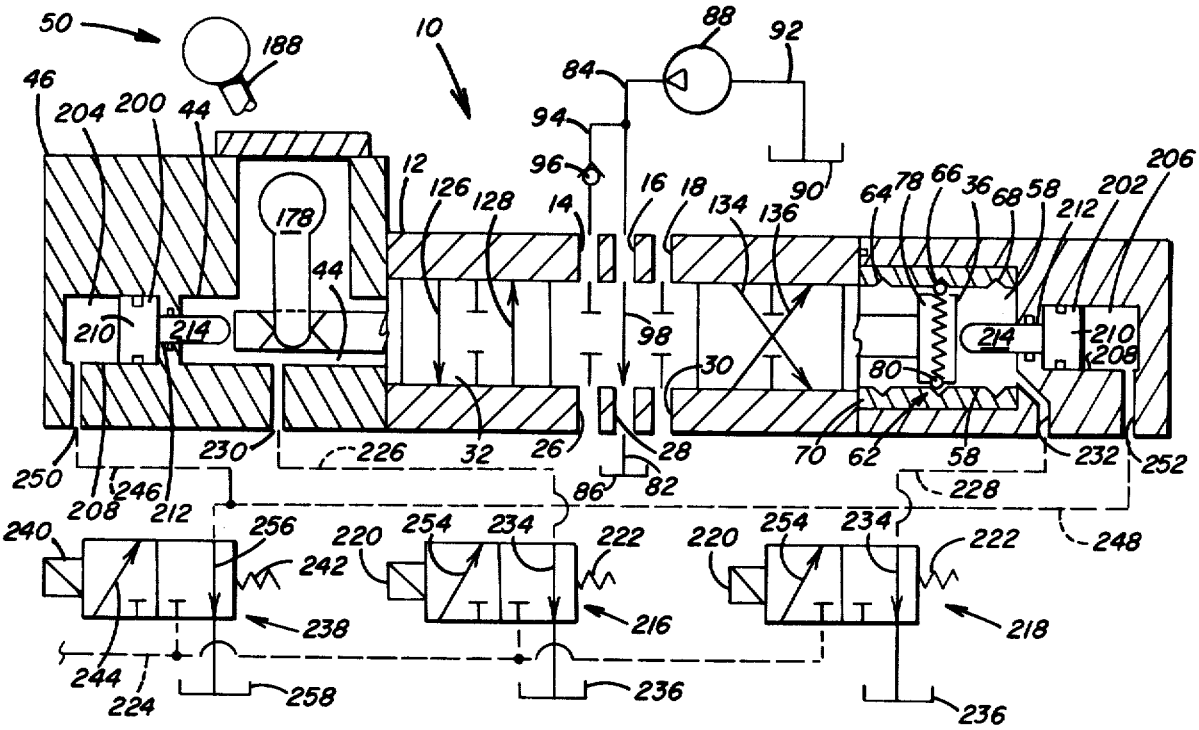
FIG. 4 is a schematic view of another embodiment of the present invention, illustrating centering apparatus positioned at each end of the valve members and operated by separate pilot valves.

A further embodiment of the present invention is illustrated in FIG. 4, in which like numerals refer to like parts of FIG. 1. In FIG. 4 the control valve 10 is modified by providing pistons 200 and 202 opposite the ends 34 and 36 of the valve member 32 in the end housings 46 and 60 respectively. With this arrangement the pistons 200 and 202 are slidably disposed in the fluid chambers 204 and 206 that communicate with chambers 44 and 58 of the end housings 46 and 60. Each fluid chamber 204 and 206 includes an enlarged diameter portion 208 for receiving cylindrical base 210 of each piston and a reduced diameter portion 212 for receiving the rod portion 214 of each piston 200 and 202.

The rod portions 214 of each piston have a fixed length and thus a limited stroke in the fluid chambers 44 and 58 so that when the pistons are fully extended they are bottomed in the chamber portions 208. Fully extending both pistons 200 and 202 moves the valve member 32 from either one of the end positions to the center position. The ball bearings 80 are moved from either recess 64 or recess 68 to the center recess 66 and are retained therein by the biasing forces of spring 78. The movement of the valve member 32 is controlled by solenoid operated, pilot valves 216 and 218 which are three-way, two-position valves each being operated by solenoid 220 and biased by spring 222. Each valve receives pressurized fluid from a source through conduit 224 and conveys the fluid through conduits 226 and 228 to pilot ports 230 and 232 communicating with fluid chambers 44 and 58 of the valve 10.

To center valve member 32 in the valve chamber 20 for fluid flow from inlet 16 to tank port 28 and to tank 86, as illustrated in FIG. 4, the pilot ports 230 and 232 are vented for flow of fluid through the pilot valves 216 and 218 in the direction of arrows 234 to tanks 236. A third three-way, two position pilot valve 238 having a solenoid 240 and being normally biased by spring 242 is actuated to conduct fluid from conduit 224 through the valve 238 in the direction of arrow 244 to conduits 246 and 248. Conduits 246 and 248 convey fluid to pilot ports 250 and 252 that communicate with fluid chamber portions 208. In this manner the chamber portions 208 behind the pistons 200 and 202 are pressurized to maintain the piston rods 214 fully extended through the chamber portions 212 and in abutting relation with the respective ends of the valve member 32. Extension of the pistons 200 and 202 shifts the valve member 32 to move ball bearings 80 into the recess 66 to lock the valve member 32 in the center position as illustrated in FIG. 4.

To move the ball bearings 80 into recess 68 for fluid flow from valve inlet 14 to valve outlet 26, pilot valve 216 is actuated to convey fluid from conduit 224 through pilot valve 216 in the direction of arrow 254 to conduit 226 and pilot port 230. Pilot valve 218 is deenergized to vent pilot port 232 to tank 236. Also, pilot valve 238 is deenergized for venting pilot ports 250 and 252 through pilot valve 238 in the direction of arrow 256 to a tank 258. Similarly, to move the ball bearings 80 into recess 64 for fluid flow from valve inlet 14 to valve outlet 30, pilot valve 218 is actuated to pressurize fluid chamber 58. Pilot valve 216 is deenergized to vent fluid chamber 44, and pilot valve 238 is deenergized to vent fluid chamber 204 and 206. Also, the control valve of FIG. 4 is manually operable by the override control 50 in the manner above discussed.

Figure 5:
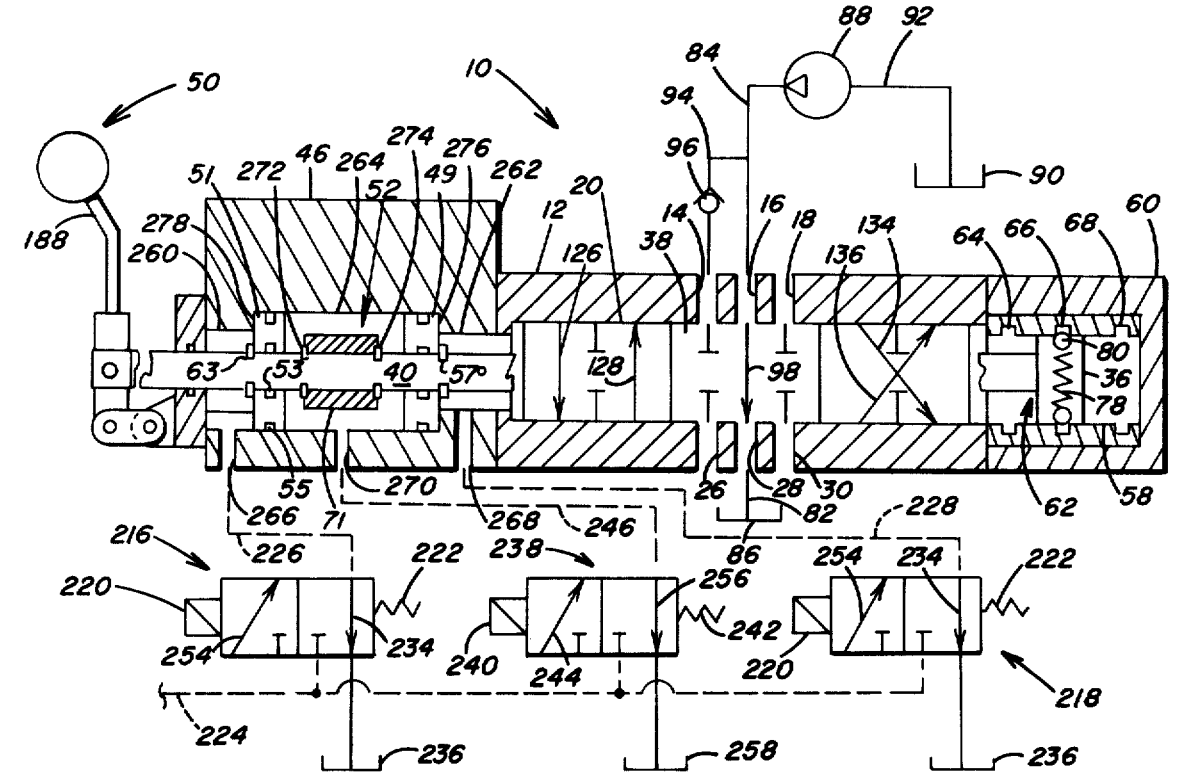
FIG. 5 is a schematic view of a further embodiment of the present invention, illustrating a centering apparatus movably positioned on one end of the valve member.

The pilot valves 216, 218 and 238 are also operable with the additional embodiment of the directional control valve 10, illustrated in FIG. 5, in which a double acting centering apparatus 52 is provided in the end housing 46 in a manner similar to that illustrated in FIG. 1A. For purpose of illustration, like numerals in FIG. 5 refer to like parts in FIGS. 1A and 4, in which pilot valves 216 and 218 are operable to move the valve member 32 to the end positions in chamber 20 where ball bearings 80 engage recesses 68 and 64 respectively. Pilot valve 238 is operable to shift the valve member 32 to a center position in the valve chamber 20 by moving ball bearings 80 into recess 66 from either one of the recesses 64 or 68.

Piston members 49 and 51 are longitudinally movable on the valve member end portion 40 and sealingly engage the end portion 40 and housing 46 to form separate fluid chambers 260, 262 and 264 having pilot ports 266, 268 and 270 respectively. A spacer 71 is fixed on the end portion 400 by snap rings 272 and 274. The pistons 49 and 51 are movable on the end portion 40 between the spacer 71 and the respective shoulders 276 and 278 of the end housing 46.

In operation to conduct fluid from inlet 14 to outlet 26 with the valve member 32 centered in chamber 20, as illustrated in FIG. 5, pilot valve 216 is energized and pilot valves 218 and 238 are deenergized. In this manner fluid chamber 260 is pressurized and fluid chambers 262 and 264 are vented to their respective tanks. Pressurized fluid enters chamber 260, thereby displacing piston 51 on end portion 40 into abutting relation with spacer 71. Continued movement of piston 51 in abutting relation with spacer 71 moves the valve member 32 and ball bearings 80 move from recess 6 to recess 68. Similarly, to conduct fluid from inlet 14 to outlet 30, pilot valve 218 is energized and pilot valves 216 and 238 are deenergized. In this manner fluid chamber 262 is pressurized and fluid chambers 260 and 264 are vented. This allows piston 49 to move on end portion 40 into abutting relation with spacer 71 and thereby displace the valve member to move the ball bearings 80 into recess 64.

To move the valve member 32 of FIG. 5 from either extreme end portion to the neutral or center position, as illustrated in FIG. 5 for conducting fluid from inlet 16 to tank port 28 and tank 86, pilot valve 238 is energized, and pilot valves 216 and 218 are deenergized. In this manner fluid chamber 264 is pressurized, and fluid chambers 260 and 262 are vented to tanks 236. Fluid entering chamber 264 through pilot port 270 moves one of the pistons 49 or 51, depending upon the end position of the valve member 32 before centering out of contact with the spacer 71 and into contact with its respective snap ring 57 or 63 secured to end portion 40. Continued movement of the piston moves the end portion 40 so that the valve member 32 is shifted laterally and ball bearings 80 are disengaged from either recess 64 or recess 68. The piston 49 or 51 continues to move until it contacts either housing shoulder 278 or 276. In this position ball bearings 80 engage recess 66 to lock the valve member 32 in the center position.

The valve member 32 is thus maintained in the center position by the detent apparatus 62. It is not necessary to maintain the pilot valve 238 energized and the fluid chamber 264 pressurized to maintain the center position of the valve member 32. Also, the other pilot valves 216 and 218 may be deenergized once the valve member 32 is moved to the selected end position because the detent apparatus 62 locks the valve member 32 in position until one of the pilot valves 216 or 218, or pilot valve 138 is actuated, or the manual override control 50, which is suitably linked to the end housing 46 and connected to the valve member end 34, is actuated.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. In a directional control valve having a valve housing with a chamber therein, inlet port means in said housing and opening into said chamber for supplying fluid from a source to said chamber, a plurality of outlet ports in said housing and opening into said chamber, a valve member slidably positioned in said valve chamber, said valve member having opposite end portions, said valve member being operable to place said inlet port means and said outlet ports in fluid communication in a preselected arrangement with each other, the improvement comprising, fluid actuated pilot valve control means for conveying pressurized fluid to a selected one of said valve member end portions to move said valve member in said chamber in a first direction to a first end position to place in a first arrangement said inlet port means in fluid communication with said outlet ports and in a second direction to a second end position to place in a second arrrangement said inlet port means in fluid communication with said outlet ports, detent means for locking said valve member in a selected one of said first and second end positions and thereby maintain the selected position of said valve member in the absence of fluid pressure applied to said selective end portion of said valve member, a lever positioned in said valve housing and pivotally connected to said valve member for moving said valve member to a selective one of said positions in said chamber, centering means having a predetermined length of travel between a first position and a second position for actuating pivotal movement of said lever to shift said valve member from either one of said first and second end positions in said chamber a distance corresponding to said predetermined length of travel of said centering means to a center position between said first and second end positions, said detent means including means for locking said valve member in said center position, fluid actuating means for energizing said centering means to move from said first position to said second position and thereby pivot said lever to position said valve member in said center position, and manually operated control means connected to said lever for pivoting said lever to shift said valve member to a position in said chamber where said detent means locks said valve member in a selected one of said first and second end positions and said center position.

2. A directional control valve as set forth in claim 1 which includes, said lever being operable to shift the position of said valve member in said chamber between said first and second positions, and said centering means having end portions arranged to move from a retracted position to an extended position into contact with said lever to pivot said lever and thereby shift said valve member to said center portion when said centering means is in said extended position.

3. A directional control valve as set forth in claim 1 in which said actuating means for moving said centering means includes, separate pilot valve control means for supplying fluid under pressure to said centering means for moving said centering means from said first position to said second position and thereby pivot said lever to move said valve member to said center position in said chamber.

4. A directional control valve as set forth in claim 3 in which, said separate pilot valve control means being operable to convey fluid under pressure to said centering means and move said centering means from a retracted position to an extended position to pivot said lever and thereby shift said valve member to a neutral position in said chamber centered between said first and second end positions.

5. A directional control valve as set forth in claim 1 in which said pilot valve control means includes, electrohydraulic pilot operated valve remotely operable to convey pressurized fluid to a selected end of said valve member to move said valve member between said first and second end positions.

6. A directional control valve as set forth in claim 1 in which said centering means includes, a pair of fluid chambers in the valve housing each having an enlarged portion and a reduced portion open to said enlarged portion, a shoulder formed by said enlarged portion and said reduced portion, a piston member slidably positioned in each of said fluid chambers, said piston member having an end portion and an annular portion arranged to abut said shoulder so that said piston member extends a preselected distance into said fluid chamber reduced portion, said piston member being operable to transmit a force to said valve member to move said valve member to said center position when said annular portion abuts said shoulder, and said actuating means being operable to convey fluid under pressure to said fluid chamber enlarged portion to displace said piston member end portion into said chamber reduced portion.

7. A directional control valve as set forth in claim 6 which includes, said piston member end portion arranged to move into abutting relation with said lever and pivot said lever to move said valve member to said center position in said chamber upon actuation of said actuating means.

8. A directional control valve as set forth in claim 1 in which said detent means includes, a plurality of annular recesses formed in said valve housing surrounding said chamber, said recesses each corresponding to a preselected position of said valve member in said valve chamber, and spring biased detent means surrounding said valve member for engaging a selected one of said recesses so that said valve member is positioned in said valve chamber and captured in a preselected position to maintain said inlet port means in fluid communication in a preselected arrangement with said outlet ports and thereby convey fluid in a preselected flow path through said valve housing.

* * * * *